United States Patent [19]

Rumph

[11] 3,981,039

[45] Sept. 21, 1976

[54] PORTABLE GOLF BALL WASHING DEVICE

[75] Inventor: Joel D. Rumph, El Dorado Hills, Calif.

[73] Assignee: D-J Enterprises, Inc., El Paso, Tex.

[22] Filed: July 18, 1975

[21] Appl. No.: 597,155

[52] U.S. Cl. ..... 15/21 A
[51] Int. Cl.[2] ..... A63B 47/04
[58] Field of Search ..... 15/21 A, 97 R

[56] References Cited

UNITED STATES PATENTS

| | | | |
|---|---|---|---|
| 1,768,229 | 6/1930 | Blakemore | 15/21 A |
| 1,792,211 | 2/1931 | Brewer | 15/21 A |
| 1,823,347 | 9/1931 | Case | 15/21 A |

*Primary Examiner*—Edward L. Roberts
*Attorney, Agent, or Firm*—James J. Brown

[57] ABSTRACT

A portable machine for washing dirt, mud and other types of foreign matter from the surface of golf balls comprising a short cylindrical container whose upper and lower interior surfaces are fitted with roughly textured resilient scrubbing pads and whose upper surface contains a water tight, sealable opening with a hinged snapfast lid providing a means whereby a golf ball may be introduced into the confines of said short cylindrical container and sealed within and whereby water, surfactants and other materials may also be introduced into the confines of the system and through which the entire inner system may be cleansed as needed. Further, said portable machine also comprising a permanently mounted, manually operated rotational means that when rotated in a clockwise direction causes a golf ball, which has been introduced into the system, to be rotated circularly around the inner dimensions of said short cylindrical container in such a manner that the upper and lower surface scrub pads in cooperation with the surfactant solution remove alien deposits, wash and thoroughly cleanse the outer surface of the rotated golf ball and whereby, on the other hand, counter-clockwise rotation of the rotational means causes upon the manual opening of the snapfast hinged lid in the upper surface a previously introduced golf ball to ride up upon the internally contained components of the rotational means and thus to be ejected from the system. Additionally, the system is so designed that allowance is made for replenishment of wash solutions as well as for the complete cleansing of the internal system by its being simply rinsed in a stream of water such as flows from a common water tap.

4 Claims, 4 Drawing Figures

PORTABLE GOLF BALL WASHING DEVICE

SUMMARY OF THE INVENTION

The present invention relates to a new and unique portable gold ball washing device that may readily be carried by a golfer on or in his golf bag in an effortless manner to all areas of a golf course, that is instantly ready for use at all times and which when employed will effectively remove dirt, mud and other foreign materials from the outer surface of golf balls in a minimum of time while providing maximum user convenience.

BACKGROUND OF THE INVENTION

In the game of golf, the need to clean the ball occurs with great frequency because of the varied soil and grass conditions existing at any one time on the golf course along the path of play. The ball not only becomes camouflaged with grass stains, mud and water stains, so that it is difficult to follow in flight and almost impossible to find once it rolls to a stop on the fairway, in the rough or a sand trap, but also is quite often affected in its direction of flight, direction of roll out or putting accuracy by foreign matter that clings to its suface. This problem has been thoroughly recognized by those who control golf course designs, and it is not at all uncommon to find golf ball washers of various design permanently installed at points near the club houses or pro-shops or on the individual tees used to begin the play on each of the various holes 1 thru 9 or 1 thru 18; however, the tees for the various holes are in fact many yards, mostly 100 yards to 300 yards or further from the putting greens where the greatest accuracy is required. The golf ball most normally needs cleaning along its way from the tee to the putting green or upon its arrival on the putting green for it is along this path that it comes in contact with the elements that get it dirty, yet normally there is no means to clean it until the next tee has been reached.

Therefore, the player must at various points along the route of play throw out another ball, or for that matter several balls, if he has them available, to achieve the maximum playing accuracy possible which may be better obtained with a clean and truly spherical ball. This is not always possible as it often takes several balls to reach the putting green where the most accuracy is required, and the distance from the putting green to the next tee or the previous tee is too great for a player to traverse back and forth to clean a ball prior to putting it in putting play where perhaps the greatest roll out accuracy of the game is required and where a ball containing foreign materials is most desirable because said foreign materials may have the greatest effect upon the ball's accuracy during intricate putting maneuvers.

The present invention provides an efficient and conveniently sized golf ball washer that will readily fit in a golf bag pocket or that may be conveniently hung on the outer surface of a golf bag and thereby be readily available to the golfer at all times during the playing period. Further, it provides such features as a unique water-tight seal which prevents contained fluids from spilling out, large and convenient openings which allow for easy cleaning and the replacement of cleansing solutions as they are depleted and convenient means for insertion and extraction of golf balls.

OBJECTS OF THE INVENTION

An important object of this invention is to provide a portable golf ball washing device that may be carried in an effortless manner to all areas of a golf course in or on a golf bag.

Another object of this invention is to provide a means for propelling a golf ball along a confined path within a closed cylindrical container.

Yet another object of this invention is to provide a means whereby a golf ball may be removed from a closed cylindrical container through a small opening in an effortless manner.

A still further object of the present invention is to provide a means for scrubbing clean the outer surface of a golf ball as it is propelled along a confined path within a closed cylindrical container.

Another object of this invention is to provide a means of sealing fluids within a contaner by the use of a snap-shut lid in such a manner that they will not leak from the container.

Yet another object of this invention is to provide pads of such a nature that their resilience in cooperation with their texture and an induced surfactant will thoroughly clean the outer surface of golf balls that are pushed between two such pads of slight thickness which are so spaced, one above the other, that their resilience exerts a steady pressure upon the outer surface of said golf balls.

A still further object of this invention is to provide a rotatable spiral ramp means within a closed cylindrical container that will, when rotated in one direction, cause constricted golf balls to ride up upon said ramp and thus be lifted from the confines of said closed cylindrical container through an appropriate opening and which, when rotated in the other direction, causes contacted golf balls to be pushed along in front of said ramp throughout its path of rotation.

A further object of this invention is to provide an exterior means of manually rotating a rotational means contained within a closed cylindrical container in both clockwise and counter-clockwise directions.

These and other objects are accomplished according to the present invention which comprises a pair of scrubbing pads mounted parallel one to other on opposite interior top and bottom surfaces of a closed cylindrical container, said container containing a surfactant solution and an externally rotatable ball pusher and ejection ramp means, and an opening in its upper surface which is complete with a hinged, snap shut, water tight lid, all of said components cooperating to, in essence, form an effective portable golf ball washing machine.

Other objects and many of the attendant advantages of this invention will be readily appreciated as the same becomes better understood by reference to the following detailed descriptions when considered in connection with the accompanying drawings wherein.

In the drawings wherein for the purpose of illustration there is shown a preferred embodiment of the invention and wherein similar reference characters designate corresponding parts throughout the several views, the complete device is designated (1).

Figure 1:
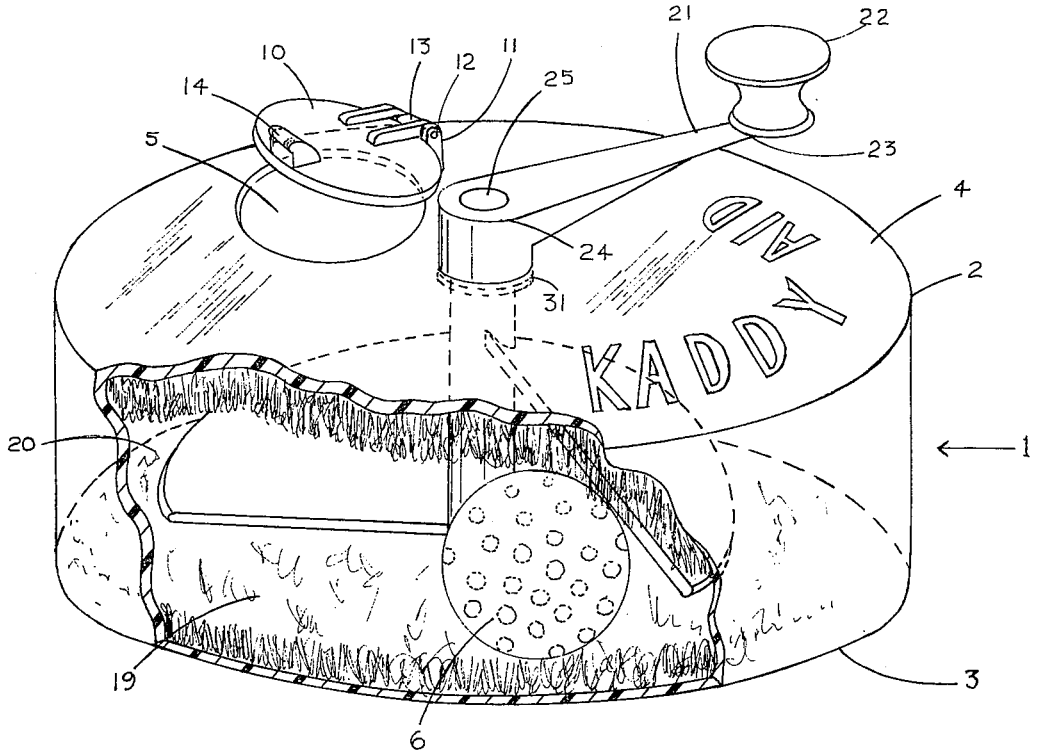
FIG. 1 is a perspective view showing a preferred embodiment of the current invention.
Figure 2:
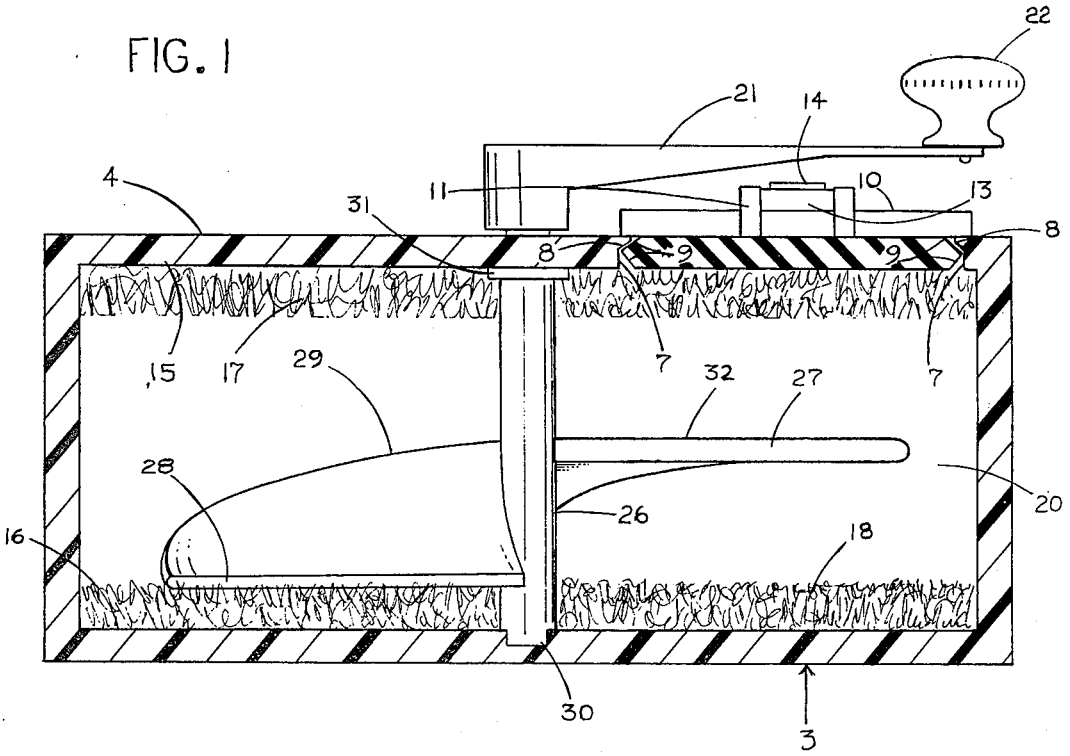
FIG. 2 is a side plan view of the current invention.
Figure 3:
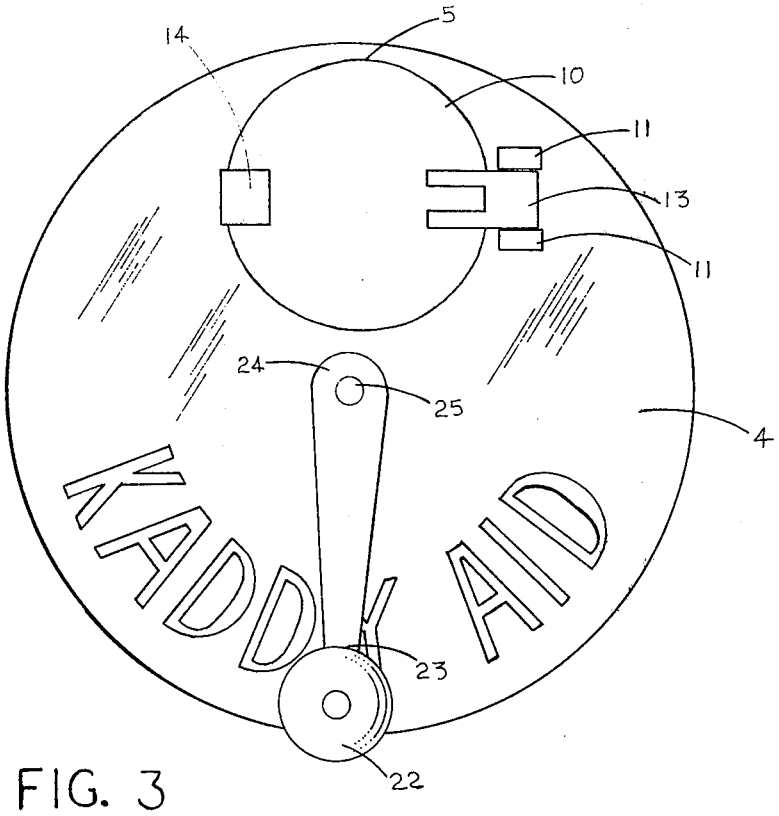
FIG. 3 is a top plan view of the current invention.

Reference FIGS. 1, 2 and 3, FIG. 1 shows a preferred embodiment of the present invention (1) which, in essence, comprises a short sealed cylindrical container (2) having a solid bottom (3) and a top (4) which in turn contains a circular opening (5) to thus provide a means whereby a golf ball (6) or other similarly sized spherical object may be inserted into the cylindrical container (2) through said circular opening (5). The edges of the circular opening (5) may be uniquely fashioned to be recessed (7) and beveled (8) to provide a means whereby the doubled beveled edge (9) of hinged lid (10) which is made of a resilient material such as rubber will upon being pressed into said circular opening (5) form a water-tight seal with the beveled edge (8) of the circular opening (5) to thus provide a leakproof seal to prevent the flow of liquids from the cylindrical container (2). Lid (10) is conveniently hinged to top (4) of container (2) by a pair of posts (11), a retention/swivel pin (12) and a pivot (13) arrangement whereby the posts (11) are molded as a contiguous component of the top (4) and the pivot (13) being molded as a contiguous component of the lid (10). Said post (11) and pivot (13) components being retained one to the other by pin (12) which is fabricated of materials similar to that from which the lid (10) and container (2) are fabricated. The lid (10) also possesses a small lever (14) for opening and closing ease which is molded as a contiguous component of lid (10) and which projects upward from lid (10) at a point directly across the diameter of the lid from its contiguously moulded pivot (13), said lever (14) providing a means whereby lid (10) may be easily opened.

Reference FIG. 2, within the confines of the closed cylindrical container (2) and permanently attached by suitable means to the lower surface (15) of the top (4) and to the upper surface (16) of bottom (3), there are the upper (17) and lower (18) scrub pads. The scrub pads (17) and (18) are fabricated from rough and resilient materials of natural or man-made origin such as bristles. They advantageously may cover substantially the entire interior top and bottom surfaces of the chamber and extend from their attached surface toward each other to such a degree that a spheroid of the approximate diameter of a standard golf ball (6) may be forced to roll between the scrub pads (17) and (18) contact a previously introduced liquefied surfactant (19) which adheres to the pads; said pads (17) and (18) exerting sufficient pressure upon the golf ball (6) to in cooperation with the surfactant (19) remove any deposits, stains and foreign material from the surface of the ball (6) and thereby render it clean.

Figure 4:
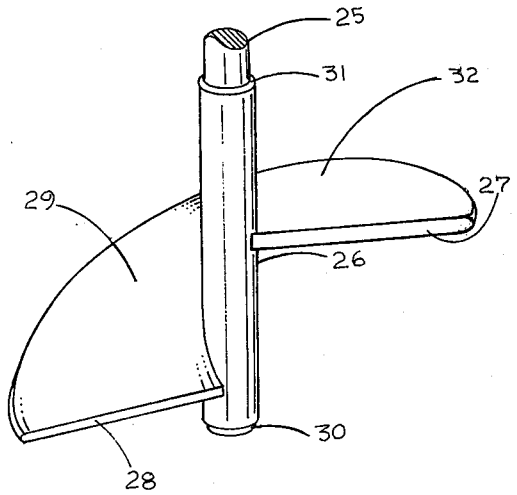
FIG. 4 is a perspective view of the ball pusher and retrieval ramp.

Referring to FIGS. 1, 2 and 4, the present invention (1) contains a mechanical means for driving a spheroid, such as a golf ball (6), between the scrub pads (17) and (18) along a circular path within the confines (20) of the closed cylindrical container (2) and retrieving said spheroid from the confines (20) of the cylindrical container (2), said mechanical means comprising a handle (21) having a fully swiveled knob (22) attached to its outer end (23) and being solidly fastened at its innermost extremity (24) perpendicularly to a protrusion (25) of the internal component of a rotatable spiral inclined plane adapted to both push the ball in a circular direction or retrieve the ball so that when the handle (21) is rotated in a counter-clockwise direction, the internally mounted driving and retrieval spiral (26) is likewise rotated in a counter-clockwise direction, and conversely, when the handle (21) is rotated in a clock-wise direction, the internally mounted spheroid driving and retrieval spiral (26) is caused to rotate in a clockwise direction.

The clockwise and counter-clockwise rotational capability of the driving and retrieval spiral (26) and its unique shape cooperate to effect the dual functions required of this component. For example, to operate the present invention it is noted that the first step is to pour a slight amount of a surfactant through the circular opening (5) into the confines of the cylindrical container (2), close lid (10) and shake the device to spread a coating of the surfactant (19) over the fibers of the scrub pads (17) and (18). Once this had been accomplished, the device is ready for use. The user now opens lid (10) and inserts a spheroid such as a golf ball (6) through circular opening (5) into the confines (20) of the cylindrical container (2), then closed lid (10) by firmly pressing it into circular opening (5). The user now grasps knob (22) and rotates the handle (21) in a clockwise direction. This rotation is transferred to the driving and retrieval spiral (26) whose front edge (27) contacts the inserted spheroid and forces it to roll along a circular path with the confines (20) of the cylindrical container (2) and between the scrub pads (17) and (18), whereupon the golf ball (6) is cleansed of any and all foreign material by the scrubbing combined actions of the surfactant coated scrub pads (17) and (18) as it is forced to roll between the scrub pads (17) and (18). The operator makes several complete clockwise revolutions of the handle (21) to assure complete cleansing of the golf ball (6), then opens lid (10) and slowly rotates the handle (21) in a counter-clockwise direction. This counter-clock-wise rotation of handle (21) is imparted to the driving and retrieval spiral (26) to which it is firmly attached causing the rear edge (28) of the driving and retrieval spiral to scoop under the golf ball (6) that has just been cleansed forcing it to ride upward on the spiral inclined plane (29) as it is rotated. As the golf ball (6) passes into circular opening (5), it rises up on the spiral inclined plane (29) and passes through circular opening (5) as the counter-clockwise rotation is continued up to the point that the golf ball (6) reaches the uppermost portion (32) of the spiral pump (29) whereupon the user of the present invention plucks the golf ball (6) from its exposed position. The lid (10) is then reclosed and the device is set aside to await further use. Components, not previously mentioned, that contribute to the effective operation of the present invention include a lower bearing recess (30) which assists in the alignment of the shaft of the spheroid driving and retrieval spiral (26) as well as providing its lower bearing surface and an upper bearing and fluid seal (31) to provide an upper bearing surface as well as to prevent the leaking of surfactants from the confines (20) of the cylindrical container (2).

Various changes may be made to the form of the invention herein shown and described without departing from the spirit of the invention or scope of the claims.

Having described this invention, what I assert as new and pray issuance of letters of patent for, is:

1. A washing device for a small, spherical object comprising a cylindrical container having a closed top and bottom with a sealable top opening scrubbing means disposed on the interior surface of the top and bottom of the cylinder and externally rotatable means disposed within said container for moving said spherical object in a circular direction between said scrubbing means; said rotatable means comprising a spiraling inclined plane with an axis of rotation generally coincident with the perpendicular axis of the cylinder and adapted to move said spherical object between said scrubbing pads when turned in one direction and to displace said spherical object in an upward direction through said top opening when turned in the other direction.

2. The device of claim 1 wherein the axis of rotation of said spiraling inclined plane passes through the top of said cylinder and is attached to handle means for turning the plane in either direction.

3. The device of claim 1 which is specifically adapted to scrub and wash golf balls.

4. The device of claim 1 wherein the entire structure is sealed to prevent leakage of fluids contained therein.

* * * * *